United States Patent [19]

Lundström

[11] 4,295,591

[45] Oct. 20, 1981

[54] NAIL PRESS

[75] Inventor: Sten Lundström, Borås, Sweden

[73] Assignee: Aktiebolaget SKF, Gothenburg, Sweden

[21] Appl. No.: 114,251

[22] Filed: Jan. 22, 1980

[30] Foreign Application Priority Data

Jan. 30, 1979 [SE] Sweden ..... 7900785

[51] Int. Cl.[3] ..... B27F 7/15

[52] U.S. Cl. ..... 227/142; 100/257; 100/913; 227/144; 227/152

[58] Field of Search ..... 227/130, 144, 152, 142; 100/257, DIG. 13

[56] References Cited

U.S. PATENT DOCUMENTS 1,139,938 5/1918 Weinstein ..... 227/144
3,157,112 11/1964 Truhon ..... 100/257 X
3,358,589 12/1967 Hentzschel ..... 227/152 X
3,362,322 1/1968 Moehlenpah ..... 227/152 X
3,402,869 9/1968 Otis ..... 227/152

FOREIGN PATENT DOCUMENTS 402971 12/1933 United Kingdom ..... 100/257

*Primary Examiner*—Paul A. Bell
*Attorney, Agent, or Firm*—Eugene E. Renz, Jr.

[57] ABSTRACT

The invention refers to a nail press, which can be used either mounted in a work bench or as a portable hand tool. It mainly consists of a U-shaped yoke, which at one of its ends carries a hydraulic press tool incorporating a piston having a movable press plate and which at its other end carries an adjustable shaft with a second movable press plate. Nail plates are intended to be fitted on the press plates.

5 Claims, 2 Drawing Figures

NAIL PRESS

BACKGROUND AND SUMMARY OF THE INVENTION

The present invention refers to a nail press, which is intended to be used either mounted in a work bench or as a hand tool.

Nail presses are earlier known in itself. They are primarily used in factories for manufacture of rafters and similar wooden structures. The machines work thus that one or two plates provided with projecting nails are pressed into two boards which are placed against each other. The known machines are stationary and big, whereby they can be used in the factory premises only.

In building yards there is a big wastage of boards, at a rough estimate about 20%. This represents a big cost and it is of course desirable to reduce this wastage to a minimum.

Rafters and the like often need to be completed or repaired at the building yards. In the present situation such a work must be done with aid of nails and hammer and often with aid of extensions, which result in heavy joints. Such joints are a very big hindrance for thermal insulation.

It has long been a strong desire to be able to overcome the above mentioned problems at the building yards, and these problems have according to the present invention been solved by providing and using a nail press either mounted on a work bench or as a portable hand tool, which nail press is characterized thereby that it incorporates a yoke, at one end of which is fitted a hydraulic press tool incorporating a piston with a movable press plate, on which a nail plate is intended to be mounted, whereas at the opposite end of the yoke there is mounted an adjustable shaft carrying a second movable press plate facing the first press plate and being intended to receive a second nail plate to be fitted thereon.

According to the invention it is appropriate to fit the nail plates to the press plates by means of magnetic attachment devices.

For guiding the nail plates when they are placed in the press the press plates should be provided with resilient stop means.

The yoke of the nail press shall, when the press shall be used in a work bench, be provided with an attachment device, about which the nail press may be pivotably supported.

It is essential, when the nail press is used in a work bench, that the lower nail plate will be situated below the edge of the table for ascertaining that the introduction of boards between the nail plates is not obstructed. In order to ascertain this a stop device is arranged in such a manner that the pivotable press rests against this stop when the press is not operating.

The embodiment of the nail press intended to be used as a hand tool should be provided with a handle.

BRIEF DESCRIPTION OF THE DRAWINGS

The invention will hereinafter be further described with reference to the accompanying drawings.

DESCRIPTION OF THE PREFERRED EMBODIMENT

Figure 1:
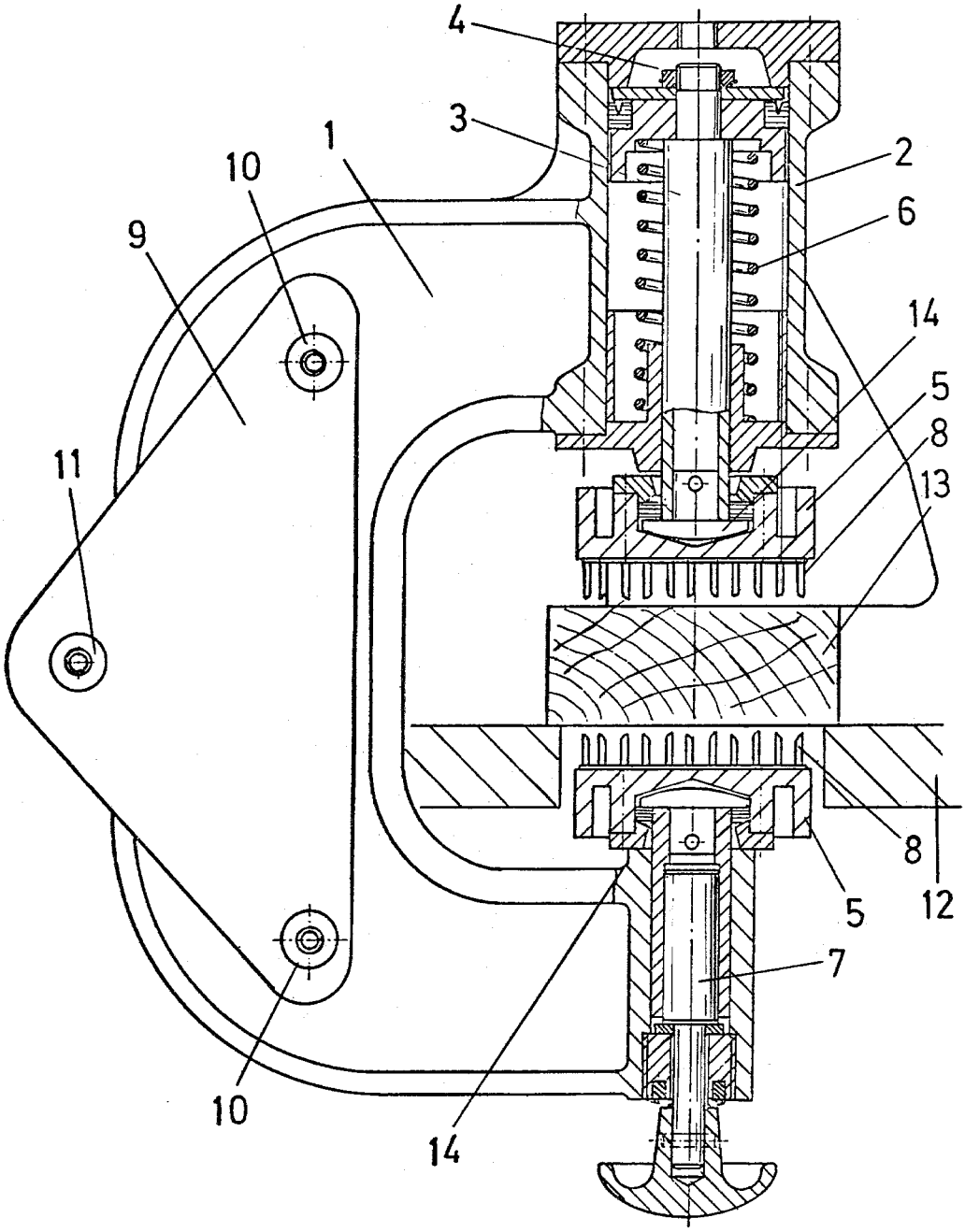
FIG. 1 shows in a partial section a nail press according to the invention as seen from the side.

In FIG. 1 is shown the nail press with a yoke 1, at one end of which there is attached a hydraulic press 2. This is of a design known per se and incorporates a piston 3, which by means of a pressure medium in a pressure chamber 4 will urge a press plate 5 downwards. For resetting the press plate to its initial position a spring 6 is arranged around the piston 3.

At the opposite end of the yoke 1 there is arranged an adjustable shaft 7. This carries a second press plate 5, which in principle is similar to the first one. On each of the press plates there are shown nail plates 8. These are fitted to the press plates by means of not shown magnets.

At the work bench variant the yoke is provided with an attachment device 9 fitted thereto with bolts or the like 10. This attachment device is pivotable with the nail press about a recess 11.

In the drawing is further shown the bench 12 and a board 13 inserted in the machine. The nail press, as can be clearly seen, has been pivoted somewhat downwards about the supporting point 11, whereby the lower press plate 5 with the nail plate fitted thereto has moved below the upper surface of the bench. It has thereupon been possible to insert the board 13 without obstacles.

If a pressure is produced in chamber 4 the piston 3 will be urged downwards against the board 13 and the upper nail plate 8 will be pressed into the board at the same time as the entire nail press will pivot upwards about its supporting point 11, whereby the lower press plate 5 will press the lower nail plate 8 into the board.

As the entire nail press shall move during the pressing in operation, the press plates 5 have been made movable relative to the piston 3 and to the adjustable shaft 7 respectively. This has been obtained thereby that the press plates 5 abut convex surfaces 14 on the press piston and on the adjustable shaft respectively.

Figure 2:
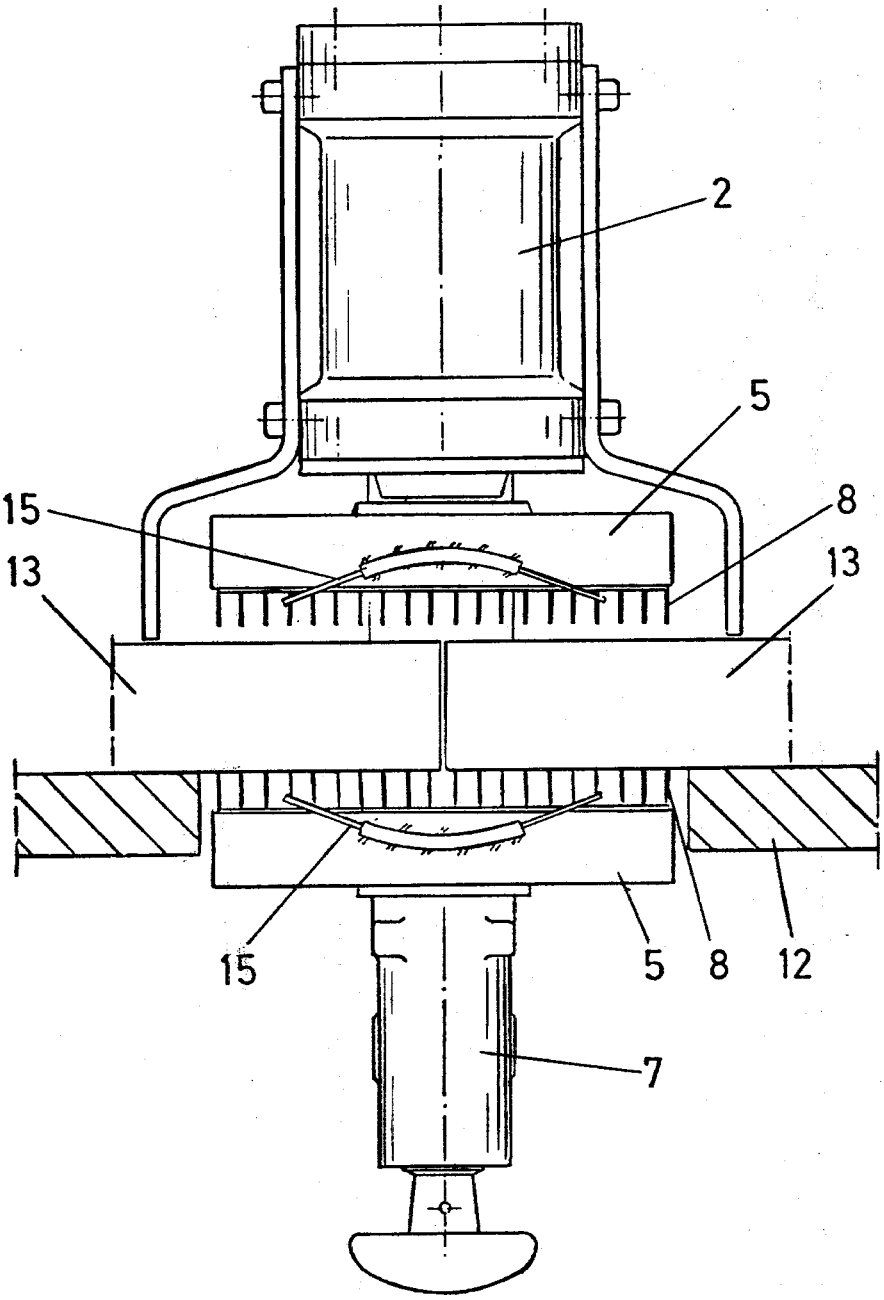
FIG. 2 shows the nail press seen from the front.

Due to this design the press plates 5 will automatically be adjusted in parallel with the board and a uniform pressing in of the nail plates 8 is obtained from both directions. In FIG. 2 is shown the nail press (as seen from the front) incorporating the hydraulic press 2, the adjustable shaft 7, the press plates 5 with nail plates 8 fitted thereto, the bench 12 and the board 13. It is further shown resilient stops 15 against which the nail plates 8 are moved to abutment during their insertion in the press. The resilient stops can of course be designed in other manners. Below the lower press plate 5 there is arranged a stop, which can be of any convenient type and which is not shown in the drawing. This stop should be adjustable to allow the lower press plate 5 to be located in a desired position at the insertion of the nail plate and the boards 13.

As mentioned above it is not necessary that the nail press is mounted in a work bench but it can also be portable. The attachment device 9 shall in that case be replaced by one or two handles. By means of the nail press according to the present invention it is thus possible in a building site easily to bring about joining of boards by means of nail plates. It is thereby possible to avoid all wastage as it in principle is possible to join all pieces of board and to obtain the length desired at the same time as the joined board will be smooth and even just about as a non-joined board. The economic advantage hereby is evident. It is also possible by aid of the hand tool to repair and also to produce rafters and the like on the work site, whereby structures can be obtained which have earlier been produced in factories.

The invention is not limited to the embodiments shown but can be modified in several ways within the scope of the appended claims.

I claim:

1. A nail press assembly comprising a yoke of generally C-shaped configuration, a hydraulic actuated piston mounted at one end of the said yoke, a shaft member aligned with said piston at the opposite end of said yoke, the confronting ends of said piston and shaft member mounting confronting first and second press plates including means for removably supporting first and second nail plates, said first and second press plates being mounted for limited universal pivotal movement on said piston and shaft member respectively.

2. A nail press assembly as claimed in claim 1 wherein said means for removably supporting said first and second nail plates includes magnetic attachment devices.

3. A nail press assembly as claimed in claim 1 wherein said shaft member is adjustably mounted so that the space between the first and second confronting press plates may be selectively varied.

4. A nail press assembly as claimed in claim 1 including resilient stop means mounted on said press plates for locating the nail plates thereon.

5. A nail press assembly as claimed in claim 1 wherein the confronting ends of the piston and shaft member are convex surfaces against which the first and second press plates engage respectively.

* * * * *